US005110010A

United States Patent [19]

Smith

[11] Patent Number: 5,110,010

[45] Date of Patent: May 5, 1992

[54] AUTOMATIC FUEL DISPENSER ACTUATOR

[75] Inventor: Leon B. Smith, Greensboro, N.C.

[73] Assignee: Gilbarco, Inc., Greensboro, N.C.

[21] Appl. No.: 586,750

[22] Filed: Sep. 21, 1990

[51] Int. Cl.[5] ..... B67D 5/12

[52] U.S. Cl. ..... 222/75; 141/392

[58] Field of Search ..... 222/74, 75; 141/392

[56] References Cited

U.S. PATENT DOCUMENTS 1,931,427 10/1933 Bond ..... 222/74
2,070,560 2/1937 Bradley ..... 222/74
3,207,370 9/1965 Bateman ..... 222/75 X
4,240,475 12/1980 Schulz ..... 141/392
4,359,074 11/1982 Maruyama et al. .
4,611,729 9/1986 Gerstenmaier et al. ..... 222/75
4,887,578 12/1989 Woodcock et al. .

*Primary Examiner*—Michael S. Huppert
*Assistant Examiner*—Gregory L. Huson
*Attorney, Agent, or Firm*—Rhodes, Coats & Bennett

[57] ABSTRACT

An improved fuel dispenser actuator includes a flap in a nozzle support such that the nozzle engages the flap when the nozzle is put into the dispenser housing and not in use. The resulting movement of the flap moves a magnet on the flap out of proximity to a reed switch, thereby opening a circuit and disabling the dispensing of fuel.

15 Claims, 1 Drawing Sheet

FIG. 1
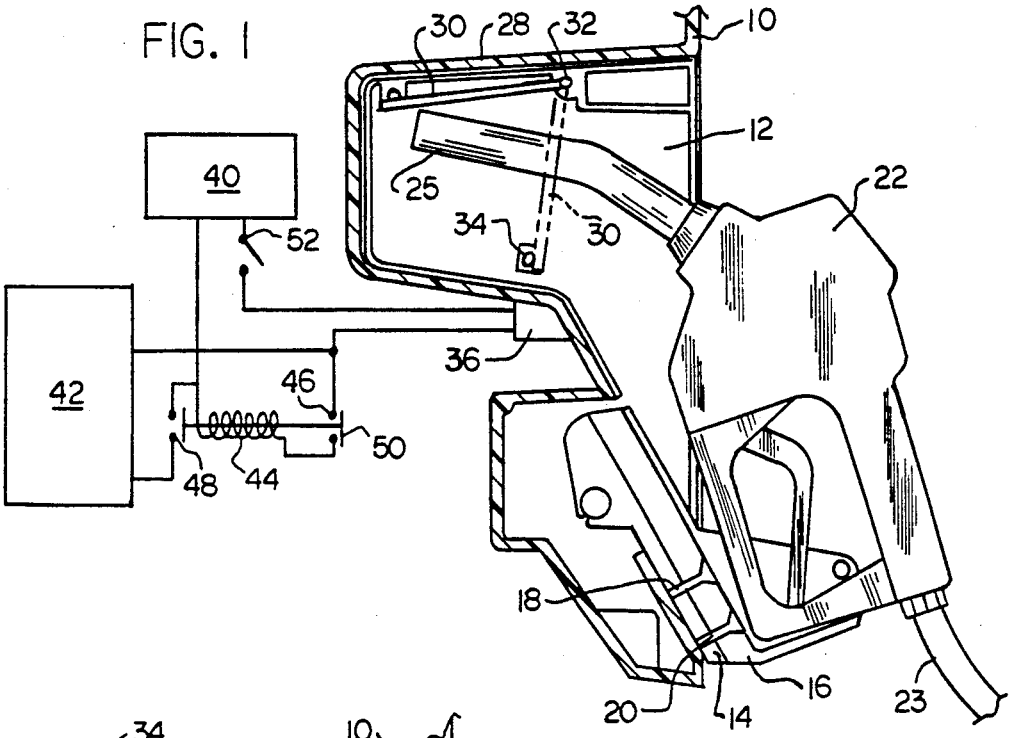
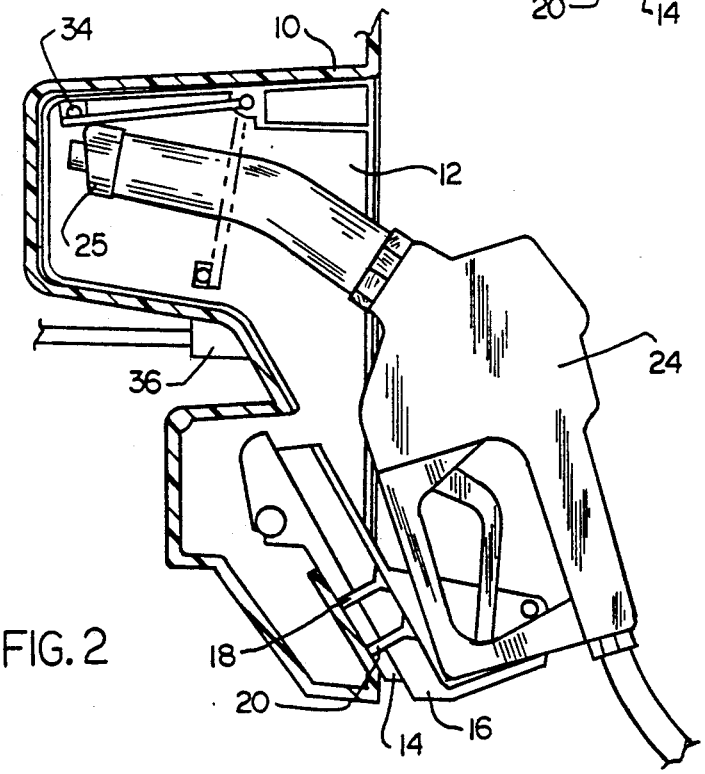
FIG. 2

AUTOMATIC FUEL DISPENSER ACTUATOR

BACKGROUND OF THE INVENTION

The present invention relates to improvements in fuel dispensers and pumps known to consumers as "gas pumps". This invention relates to an improvement in the actuating means to start and end operation of the dispenser when the fuel dispensing nozzle is removed or replaced in the dispenser housing, respectively.

The invention is particularly suitable for use in dispensers which may need to be converted between standard nozzle and vapor recovery nozzle types. One problem to be solved in such conversions is that the vapor recovery type nozzle is considerably larger than a standard nozzle, so that the nozzle receptacle or boot must be modified to receive the larger nozzle. A known dispenser is disclosed in U.S. Pat. No. 4,611,729 to Gerstenmaier et al. to permit adaptation between standard and vapor recovery size nozzles. Gerstenmaier provides an adjustable nozzle support for selectively positioning the support in the position as desired for the nozzle size in use. But, to turn the dispenser on, the nozzle support still must be moved in opposition to a spring and linkage arrangement and often, in practice, internal parts of this spring and linkage arrange arrangement also require replacement to reflect the differences in weight between the two nozzle types. In particular, the springs operating in opposition to this lifting step also require replacement with springs of appropriate tensions when changing from standard to vapor recovery nozzles.

This requires additional parts to be kept on hand and increases the length of time required to make a conversion, not to mention the added expense of the initial installation and the increased susceptibility of one or more of the multiplicity of parts to failure. Also, the linkage members extend through openings in the dispenser housing, but it is desirable to avoid having openings in the housing to prevent contamination of sensitive parts and to ensure that fuel vapors do not come into contact with potential ignition sources.

SUMMARY OF THE INVENTION

Accordingly, there is a need in the art for an improved dispenser nozzle receptacle which obviates these problems. The present invention fulfills this need by providing a fuel dispenser of the type provided with a hose connecting a dispenser housing and a nozzle which includes a metering apparatus for metering fuel through the hose. A power supply supplies power to the metering apparatus, and a nozzle support is provided in the housing for supporting the nozzle when not in use. The nozzle support is provided with a flap which is positioned to have a first orientation when the nozzle is removed from the nozzle support, and a second orientation when the nozzle is supported by the nozzle support because of dislodgement of the flap from the first orientation to the second orientation by the nozzle's placement in the nozzle support. A reed switch, Hall effect switch or other magnetically actuable switch on the nozzle support is operably associated with the power supply and the metering apparatus. A magnet mounted on the flap causes the switch to have a first state when the flap is in the first orientation and causes the switch to have a second state when the flap is the the second orientation. When the switch is in the second state, the metering apparatus is connected to the power supply and when the reed switch is in the first state the power supply is isolated from the metering apparatus.

In a preferred embodiment, the switch is located on the nozzle support adjacent the location of the magnet when the flap is in the first orientation and, more preferably, the switch is normally open. More preferably, the nozzle support includes an adjustably positionable portion on which the nozzle may be supported. More preferably, the adjustably positionable portion is adjustable between positions for receiving standard nozzles and vapor recovery nozzles, but is otherwise non-movable.

Preferably, the flap is disposed so as to assume the first orientation under the influence of gravity upon removal of the nozzle.

Desirably, the power supply includes a push-button switch which is operably associated with the switch and the metering apparatus such that the push-button switch must be closed to operate the metering apparatus. In such a case, the power supply may include a manually actuable double-pole relay, one pole of which, when closed, closes a portion of a circuit to hold the relay closed and the other pole of which, when closed, closes a portion of a circuit to the metering apparatus. More preferably, however, the functioning described herein for the relay is accomplished using software or firmware, the operation of which is conventional. Preferably, the switch when closed closes a portion of the circuit to hold the relay closed.

BRIEF DESCRIPTION OF THE DRAWINGS

The invention will be better understood from a reading of the following detailed description along with a study of the drawings in which:

FIG. 1 is a partial sectional view of a dispenser housing with a standard nozzle therein with a schematic electrical diagram forming a portion thereof; and FIG. 2 is a view similar to FIG. 1 with the nozzle support supporting a vapor recovery nozzle as distinct from the standard nozzle shown in FIG. 1.

DETAILED DESCRIPTION O A PREFERRED EMBODIMENT

FIGS. 1 and 2 are partial sectional views through a fuel dispenser housing 10 including a nozzle support or boot 12. The boot 12 includes a fixed nozzle support portion 14 and a movable nozzle support portion 16. Fixed portion 14 may be an integral portion of boot 12. Movable nozzle support portion 16 is affixed to fixed nozzle support portion 14 in a selected position by fasteners bolts 18,20 such as bolts. In the position shown in FIG. 1, the bolts 18,20 are used to mount the movable nozzle support portion 16 on the fixed nozzle support portion 14 so as to receive a standard nozzle 22. Nozzle 22 dispenses fuel supplied through hose 23 connected to the metering apparatus 42 (connection not shown) in conventional fashion. Any suitable metering apparatus may be used. A vapor recovery nozzle 24 is connected to the metering apparatus the same way when desired. In FIG. 2, the bolts 18,20 position the movable nozzle support portion 16 lower than in FIG. 1, to make a larger space in the boot 12 for vapor recovery nozzle 24. As will be appreciated, movable nozzle support portion 16 and fixed nozzle support portion 14 are provided with appropriately located predrilled holes to receive bolts 18,20 to position the movable nozzle support 16 on the fixed nozzle support 14 in the desired locations for either nozzle size. As will be apparent, other nozzle sizes can be accommodated as desired by similarly locating additional holes. Other means for variably positioning portion 16 may be substituted, as will be apparent to those of ordinary skill.

The upper part of the boot 12 includes a spout receptacle 26 having an upper wall 28. A flap 30 is pivotally mounted to upper wall 28 at pivot 32. Flap 30 is pivotal between a first orientation shown in phantom in each figure and a second orientation shown in full lines in each figure. As will be apparent, placement of the spout 25 of nozzle 22 or 24 in the boot 12 will cause the flap 30 to pivot around pivot point 32 from the first orientation to the second orientation. Conversely, removal of the nozzle will let flap 30 drop under the influence of gravity from the second to the first orientation. If desired, a spring may be provided to urge the flap from the second to the first orientation to assure return of the flap to the first orientation. Other return assists may also be substituted.

A magnet 34 mounted on flap 30 is thereby moved from a location adjacent switch 36 to a position further away from switch 36. Switch 36 is preferably a reed switch, but any other magnetically actuable switch such as a Hall effect device may be substituted. The magnet 34 and switch 36 are selected so that the magnet closes the contacts of normally open switch 36 when flap 30 is in the first orientation. As will be apparent to those of ordinary skill in the art, the switch could be made with normally closed contacts which are opened by the magnet 34 in a suitably modified electrical circuit. The switch 36 is mounted inside the dispenser housing 10, so that no openings through the housing are needed. Thus, the sealing integrity of the housing is preserved.

In the circuit depicted in FIG. 1, normally open switch 36 is in a series circuit with power supply 40 and the primary and one pole 46 of manually actuable double pole relay 44. The other pole 48 is in series between power supply 40 and metering apparatus 42. Manually actuable double pole relay 44 is provided with a push-button actuator 50 located on the outside of housing 10 of the dispensing apparatus, preferably covered by a sealing membrane to preserve the integrity of the dispenser housing 10.

Thus, in operation, upon removal of the nozzle from the boot 12, flap 30 pivots from its second orientation to its first orientation so that the magnet 34 closes the contacts of switch 36. Then, when the operator pushes push-button 50, poles 46,48 are simultaneously closed. The closing of pole 46 while switch 36 is closed by magnet 34, connects power supply 40 to the primary of manually actuable double pole relay 44 to hold the relay closed. Pole 48 of the relay is, of course, simultaneously closed by the pressing of pushbutton 50 and remains closed continuously to provide from power supply 40 to metering apparatus 42 so that fuel can be dispensed to the tank of a motorist through the nozzle 22 or 24. Actual release of the fuel from the nozzle will be under the control of a valve in the nozzle, as is conventional.

When a sufficient quantity fuel has been dispensed, the nozzle is returned to the boot 12, thereby pivoting the flap 30 from the first orientation to the second orientation. This moves magnet 34 out of proximity to switch 36, allowing switch 36 to open. This opens the circuit to the primary of manually actuable double-pole relay 44, so that that relay opens, thereby opening both poles 46,48. The opening of the poles 46,48 prevents further dispensing of fuel by disconnecting power supply 40 from metering apparatus 42, until the nozzle is removed from the boot 12, followed by another depression of push-button 50. It is also desirable to include an emergency shutoff switch 52 physically located on the dispenser housing 10 in a sealed manner, so that power to the metering apparatus 42 may be cut off in the event of an emergency without the necessity of returning the nozzle 22 to the boot 12.

As will be apparent, the operation of flap 30, magnet 34, switch 36 and the remainder of the electrical circuit are entirely independent of the size of the nozzle. That is, regardless of whether the nozzle is a standard nozzle 22 or a vapor recovery nozzle 24, the circuitry works the same, so that the only adjustment required to make a transition from a standard nozzle to a vapor recovery nozzle is the simple adjustment in position of movable nozzle support portion 16 as discussed earlier.

Additional embodiments of this invention will likely come to mind including possible extensive variations in the electrical circuit described, all of which are considered as falling within the scope of this invention. In particular, the sensing of the closing of switch 36 and depression of buttons 50,52 may be done by a microprocessor or other firmware which, in turn, controls metering apparatus 42.

What is claimed is:

1. A fuel dispenser of the type provided with a hose connecting a dispenser housing and a nozzle comprising:

a. a metering apparatus for metering fuel through the hose, b. a power supply for supplying power to the metering apparatus, c. a nozzle supporting said housing for supporting the nozzle when not in use, said nozzle support provided with a flap positioned to have a first orientation when said nozzle is removed from said nozzle support and a second orientation when said nozzle is supported by said nozzle support because of dislodgement of said flap from said first orientation to said second orientation by said nozzle's placement in said nozzle support, d. a magnetically actuable switch on said nozzle support operatively associated with said power supply and said metering apparatus, and e. a magnet mounted on said flap to cause said switch to have a first state when said flap is in said first orientation and to cause said switch to have a second state when said flap is in said second orientation, whereby when said switch is in said first state, said metering apparatus is operatively associated with said power supply to permit the dispensing of fuel through said hose and when said switch is in said second state, said power supply is isolated from said metering apparatus to prevent the dispensing of fuel through said hose.

2. A dispenser as claimed in claim 1 wherein said switch is located on said nozzle support adjacent said magnet when said flap is in said first orientation.

3. A dispenser as claimed in claim 2 wherein said switch is normally open.

4. A dispenser as claimed in claim 3 wherein said nozzle support includes an adjustably positionable portion on which said nozzle may be positioned.

5. A dispenser as claimed in claim 4 wherein said adjustably positionable portion is adjustable between positions for receiving standard nozzles and vapor recovery nozzles, but is otherwise non-movable.

6. A dispenser as claimed in claim 1 wherein said nozzle support includes an adjustably positionable portion on which said nozzle may be positioned.

7. A dispenser as claimed in claim 6 wherein said adjustably positionable portion is adjustable between positions for receiving standard nozzles and vapor recovery nozzles, but is otherwise non-movable.

8. A dispenser as claimed in claim 1 wherein said flap is disposed so as to assume said first orientation under the influence of gravity upon removal of said nozzle.

9. A dispenser as claimed in claim 1 further comprising a push-button switch which is operatively associated with said switch and said metering apparatus such that said push-button switch must be closed to operate said metering apparatus.

10. A dispenser as claimed in claim 1 in which said power supply includes a double pole relay, one pole of which when closed closes a portion of a circuit to hold said relay closed, and the other pole of which when closed closes a portion of a circuit to said metering apparatus.

11. A dispenser as claimed in claim 10 wherein said switch when closed closes a portion of said circuit to hold said relay closed.

12. A dispenser as claimed in claim 1 wherein said housing is free of openings associated with the nozzle support.

13. A dispenser as claimed in claim 9 wherein said housing is free of openings associated with said nozzle support and said push-button switch.

14. A dispenser as claimed in claim 1 further comprising an emergency shutoff switch on said housing to isolate said metering apparatus from said power supply even when said switch on said nozzle support is closed.

15. A dispenser as claimed in claim 1 wherein said switch is a reed switch.

* * * * *